United States Patent [19]

Meyer

[11] 4,310,620

[45] Jan. 12, 1982

[54] METHOD OF PROCESSING A PHOTOGRAPHIC MATERIAL USING A PROCESSING LIQUID

[75] Inventor: Rudolf Meyer, Leverkusen, Fed. Rep. of Germany

[73] Assignee: AGFA-Gevaert Aktiengesellschaft, Leverkusen, Fed. Rep. of Germany

[21] Appl. No.: 18,111

[22] Filed: Mar. 7, 1979

[30] Foreign Application Priority Data

May 10, 1978 [DE] Fed. Rep. of Germany ..... 2810465

[51] Int. Cl.[3] ..... G03C 5/30

[52] U.S. Cl. ..... 430/404; 430/206; 430/210; 430/497; 430/499

[58] Field of Search ..... 96/50, 50 W, 66; 430/497, 499, 498, 206, 210, 253, 403, 401, 404, 50 W

[56] References Cited

U.S. PATENT DOCUMENTS

| | | | |
|---|---|---|---|
| 2,906,399 | 9/1959 | Lysle et al. | 96/50 |
| 3,179,517 | 4/1965 | Tregillus et al. | 96/50 |
| 3,249,031 | 5/1966 | Gold | 96/66 |
| 3,282,695 | 11/1966 | Narodny | 96/66 |
| 3,413,181 | 11/1968 | Goldhammer | 96/50 |
| 3,416,921 | 12/1968 | Coenen | 430/206 |
| 3,510,301 | 5/1970 | Limberger | 430/206 |
| 3,574,618 | 4/1971 | Gronig | 96/63 |

FOREIGN PATENT DOCUMENTS 2244194 4/1975 France .

*Primary Examiner*—Mary F. Downey
*Attorney, Agent, or Firm*—Connolly and Hutz

[57] ABSTRACT

A photographic material is processed with a processing liquid by establishing a surface contact between the uppermost layer of the material and a flat porous spreading element impregnated with a low viscosity processing liquid. The impregnation is brought about by providing during or prior to processing for a contact between the spreading element in at least parts thereof with the liquid content of a container for the processing liquid. The spreading element may be flexible or rigid and may consist of woven or knitted fabrics, non-woven webs of endless filaments or staple fibres, non-woven webs of paper fibres, porous plastic foils or porous metal layers.

6 Claims, No Drawings

METHOD OF PROCESSING A PHOTOGRAPHIC MATERIAL USING A PROCESSING LIQUID

This invention relates to a method of processing a photographic material with a processing liquid, in which a preferably low viscosity processing liquid is distributed over the photographic material by means of a spreading sheet placed on the photographic material.

The processing of photographic materials generally necessitates the use of stationary apparatus because of the liquid processing baths in which the photographic materials have to be immersed. Attempts have been made to achieve a substantial reduction in the volume of the processing baths required so that processing can be carried out immediately after imagewise exposure without the usual dark room equipment and storage vessels for the processing liquids.

If flat boundary elements are used, a layer of processing solution can be produced on the uppermost layer of a photographic material. These boundary elements are generally impervious to the processing liquid. According to German Pat. No. 1,056,476, the elements consist of a pair of rigid plates between which is positioned the photographic material to be processed and the processing solution is introduced. U.S. Pat. No. 3,179,517 describes the use of processing sheets or processing webs impregnated with solutions for the processing of the photographic materials. These processing sheets or webs consist mainly of materials in the form of sheets or webs containing a layer of hydrophilic binder, in particular gelatine, arranged on a substrate layer and impregnated with the processing liquid. Porous, spongy materials such as a porous film of polyvinyl chloride have also been mentioned as carriers for the processing liquid. The processing sheets described in the above-mentioned U.S. Patent contain a processing liquid with additives for processing single layered black-and-white materials, but the quantity of processing liquid contained in the processing sheet is not sufficient for the complete treatment of multilayered photographic materials. Another disadvantage of these processing sheets is that the hydrophilic binders used are readily decomposed by hydrolysis so that their function is impaired if they are impregnated with the alkaline processing liquid for a considerable length of time before use and stored in this state.

The use of small volumes of processing liquids has become particularly important in connection with instant image processes in which development is carried out or at least started immediately after imagewise exposure, while the photographic material is still inside the camera or in a dark attachment connected to the camera. This procedure necessitates accommodation of the processing chemicals inside the camera and it may even be necessary to be able to associate them separately with each photographic element provided for taking one picture. Development has hitherto generally been released in instant image processes by the squeezing of a viscous developer paste out of a bag by passage of this bag between two squeezing rollers and at the same time causing the paste to be evenly distributed over the photographic layer by means of the same rollers. The paste must be highly viscous if it is to form a sufficiently uniform layer because only then is it possible to obtain the laminar flow of the paste which is necessary for even distribution. In addition, the squeezing rollers must be specially shaped to ensure that the edges of the photographic material will have the same thickness as the middle portions. The viscosity of these pastes and hence also the quality of distribution and the thickness of the layer obtained, depend to a considerable extent upon the temperature. These factors influence the development of the layers and hence the quality of the image obtained.

It is an object of the present invention to provide a method by which photographic materials can be processed with small volumes of processing solutions, using processing sheets. The method is particularly intented to ensure rapid distribution of the processing liquid in sufficient quantities over the photographic material, which material may comprise several layers, without the necessity of impregnating the processing sheets with processing liquid for any considerable length of time before use. The process should in particular make it possible to use processing sheets which are brought into contact with the processing liquid only immediately before or even during processing and which rapidly distribute the liquid uniformly over the whole surface of the photographic material by capillary forces. At the same time, the method according to the invention should ensure that the processing sheet will not be impaired in its function even if it is kept permanently in contact with the processing liquid.

It has been found that rapid and uniform distribution of the processing liquid over the photographic material which is to be processed can be achieved if a low viscosity processing liquid is used in combination with a porous spreading element which is placed on the photographic layer to be treated and which is in contact with the processing liquid at least at one point and is capable of absorbing the liquid and distributing it over its whole surface by the existing capillary forces.

This invention relates to a method of processing a photographic material with a processing liquid, in which surface contact is established between the uppermost layer of the photographic material and a flat, porous spreading element which is impregnated with photographic processing liquid, characterised in that the spreading element is in contact with the liquid contents of a container for the photographic processing liquid for at least a finite period of time during the existence of surface contact and at least in parts of its whole surface.

The method is suitable for processing any photographic materials, in particular those containing silver halide emulsion layers, e.g. single layered or multi-layered photographic materials for the production of black-and-white or colored images, and it may be used both for the production of negative and positive images. Normal processing of black-and-white materials comprises development and fixing whereas the processing of color photographic materials comprises the stages of development, bleaching and fixing (bleach fixing) to which may be added intermediate treatments, e.g. with short stop or washing baths and, in the case of reversal materials, also a second development. According to the invention, at least one of the treatment stages required, preferably at least development, is carried out using a porous spreading element which is impregnated with a processing liquid, in particular one of low viscosity, or is at least in contact with such a liquid over parts of its surface.

The processing liquids in question may be any of various liquids, such as developer, bleaching or fixing baths or baths which perform several of the functions mentioned. The processing liquid used for instant image photography may be an alkaline developer or activator liquid which in addition to a developer substance may contain the usual additives such as silver salt solvents, sequestering agents, stabilizers, and anti-oxidants. According to the invention, the processing liquids may have a low viscosity, i.e. they preferably do not contain any viscosity increasing additives of the type conventionally used in processing pastes. The viscosity $\eta$ is suitably in the region of 1 to 20 mPa.s at room temperature.

The spreading elements used may generally be porous structures in the form of sheets, in particular textile sheets such as woven or knitted fabrics or non-woven webs of endless filaments or staple fibres or also non-woven webs of paper fibres or porous plastics foils or porous metal layers, for example layers of sintered metal. Cambric has been found to be particularly suitable. Rubber-like, finely porous sponges or foams with open cells may also be used. Where rapid distribution of the processing liquid in the spreading element is important, it is advantageous to use a spreading element made of a hydrophilic material if an aqueous processing liquid is used. The capillary forces in the spreading element are evidently responsible for the rapid distribution of processing liquid. The lower the surface tension between the material of the spreading element and the processing liquid, the greater are these capillary forces. It may therefore be advantageous to add a surface active agent to the processing liquid to lower its surface tension. Suitable surface active agents for this purpose include, saponin, sodium tetrapropylene benzosulphate and salts of fluorinated fatty acids, e.g. perfluorinated ammonium caprylate.

If non-woven webs of paper fibres or textile fibres are used as spreading elements, the fibres may have a preferential orientation, in which case the liquid is also distributed preferentially in the direction of the fibres. This may be particularly advantageous for distributing processing liquid from a rectangular container, because distribution should in that case preferably occur in one direction only.

In order to increase the volume of processing liquid available, the spreading element according to the invention is combined with the liquid contents of a container for processing liquid. The spreading element may already be in contact with the liquid in the container before it is used, in which case uniform distribution of the processing liquid in the spreading element is already achieved by virtue of the porosity of the spreading element and the capillary forces present. On the other hand, the spreading element may be combined with the liquid contents of the container in such a manner that contact between the element and the liquid contents is established only immediately before or during use. For example, the spreading element may be in contact with the liquid contents of a container for processing liquid with one of its surface or with parts of this surface, and this surface may constitute part of the walls of the container. Due to the porosity of the spreading element, a suitable quantity of processing liquid is distributed in the spreading element, and it is transferred to the photographic layers only when brought into contact under pressure with the photographic material to be processed. Fresh processing liquid is constantly supplies to the distribution element to replace what has been used up.

The capacity of the container may vary according to requirement. The container may be designed to hold only sufficient processing liquid to be used once. In that case there may be used, for example, a non-woven web of fibres or a textile fabric which is of similar dimensions to the photographic material to be processed and which is impregnated with the processing liquid and is laminated on one side or even on both sides with a foil which is impervious to water, and in the latter case one of the two foils is stripped off before use to expose the impregnated spreading sheet.

One of the two laminating foils is not necessarily in firm contact with the non-woven web but may form a cavity with this web to hold unabsorbed processing liquid in case the quantity of processing liquid in the spreading sheet is insufficient for processing the photographic material or if the spreading sheet is to be used more than once.

In another embodiment, a rupturable container containing the processing solution is placed along one edge of the spreading sheet. In that case, processing may be carried out by, for example, placing the spreading sheet on the photographic material which is to be processed and then moving it, with the container in front, through a device which exerts pressure on it, for example, a pair of squeezing rollers. The container is thereby split open along a line facing the spreading sheet so that the processing liquid is poured over the porous spreading sheet and absorbed by it, and due to the capillary forces and the action of the squeezing rollers it is rapidly distributed over the whole surface so that it enters at every point into intimate contact with the photographic layer to be processed. After this treatment, the spreading sheet is removed. In this embodiment, the place where the processing liquid escapes from the breakable container is situated along one edge of the spreading sheet. If the container is designed so that the seam along which it splits extends over a length substantially equal to the width of the spreading sheet, the processing liquid will leave the container uniformly at every point of the seam and form a liquid front which migrates uniformly through the spreading sheet. On the other hand, the container could open at several points so that several separate regions along an edge of the spreading sheet come into contact with the processing liquid. However, even in this case, the processing liquid rapidly spreads over the whole surface of the spreading sheet due to the capillary forces. In yet another embodiment, the processing liquid may be directed to the centre of the spreading sheet, for example, by means of fine channels, and then spread out in all directions from there.

It is, of course, also possible to carry out the process of the present invention with spreading sheets which may be used several times. For example, a non-woven web of fibres or a textile fabric may be placed on the photographic layer, the processing liquid being then applied to the spreading sheet at one or more points, for example, by means of fine channels which are supplied with liquid from a storage vessel. Surface contact may be established and rapid distribution effected by passing the photographic material covered with the spreading element impregnated with processing liquid through a pair of squeezing rollers.

According to another embodiment of this invention, the spreading element consists of an endless flexible web moving over a system of deflecting rollers at least one of which is placed with its axis horizontal, inside a container (tank) for the processing liquid, where it is partly immersed in the liquid. The spreading element is thereby impregnated with the liquid when the deflecting rollers pass it through the liquid in the tank. The material to be processed may be introduced between the deflecting roller and the moving web before the point of immersion in the liquid, with the coated side of the material facing the web. After passing through the looping angle round the roller, the photographic material is removed from the roller, i.e. from the web leaving the roller, and, if necessary, it may then be treated with one or more additional processing liquids either by the same method according to the invention or by the usual method. The contact time is determined principably by the velocity of the web, the diameter of the deflecting roller and the looping angle of the web round the roller. In addition, it must be taken into account that the point at which the web reaches the deflecting roller, i.e. comes into tangential contact with it, is situated above the point of immersion and that, after immersion in the processing liquid, there is a certain delay before the liquid penetrates the web to reach the surface of the material to be processed. In another variation of this embodiment of the invention, the material to be processed is not brought into contact with the impregnated web until the web has left the processing liquid. Contact may be established by pressing the material, always with its coated surface facing the web, against the web by means of a resiliently mounted pressure roller when the web is deflected over a deflecting roller or by again moving the material between the impregnated web and a deflecting roller through the required looping angle round the roller, but this time outside the liquid.

In another embodiment of the process according to the invention, the porous spreading element is curved and forms the surface of a hollow cylinder which is partly or completely filled with processing solution. In order to impart the necessary mechanical strength to the spreading element in this case, it may be placed on a metal cylinder which is perforated on its curved surface so that the element can make contact with the processing liquid inside the cylinder. The processing liquid permeates the spreading element but only escapes from the surface when pressure is applied. The photographic material is pressed against the external surface of the cylinder to process it and removed after the required contact time. The hollow cylinder may be rotatably mounted and the material to be processed may be passed between the cylindrical spreading element and a rotatably mounted pressure roller. The rotatably mounted hollow cylinder containing the processing liquid may be equipped with tubes for the supply of fresh processing liquid.

According to another embodiment of the invention, the flat spreading element consists of, for example, a sintered metal plate in contact with the liquid contents of a container. The sintered metal plate and container may be arranged inside a camera equipped with devices for pressing a photographic material in the form of a sheet with its coated surface against the sintered metal plate for a certain length of time. After imagewise exposure of the sheet of photographic material, inside the camera, these devices are set in motion to develop the photographic material. The sheet of photographic material is removed from the sintered metal plate after the required contact time and may then be expelled from the camera, if necessary after the application of additional layers. In this case, the flat, porous spreading element according to the present invention is also suitable for repeated use.

As already mentioned above, the process according to the invention may be used for processing a wide variety of photographic materials. Apart from the use of disposable processing sheets which are used only once, the application of the invention to the processing of the photographic materials for instant image photography should be particularly mentioned. The diffusion transfer process is generally employed for this purpose. To produce colored images by the dye diffusion transfer process, it is customary to use a light-sensitive element which contains color-providing compounds and an image receiving element in which the desired color image is produced by diffusible dyes which are transferred imagewise. To achieve this transfer, it is necessary to establish firm contact between the light-sensitive element and the image receiving element for at least a finite period of time within the development time so that the imagewise distribution of diffusible dyes produced by development in the light-sensitive element can be transferred to the image receiving element. This contact may be established after development has started. On the other hand, it may even be established before development, for example, if the light-sensitive element and image receiving element of the photographic material form an integral unit. Embodiments of the dye diffusion transfer process are known in which such an integral unit is preserved even after termination of development, i.e. the light-sensitive element is not removed from the image receiving element after the dye has been transferred. An embodiment of this type has been described, for example, in German Offenlegungsschrift No. 2,019,430. A material of this type contains an image receiving layer on a transparent auxiliary substrate, a light impervious layer and a light-sensitive element comprising several silver halide emulsion layers and color-providing compounds associated with them. Development is initiated by bringing the light-sensitive element into contact with an aqueous alkaline processing mass after imagewise exposure. According to the invention, this may be carried out by establishing surface contact between the light-sensitive element and the porous spreading element in order to distribute the developer liquid over the light-sensitive element. If the spreading element is intended for repeated use, it is separated after the necessary contact time, and the photographic material consisting of auxiliary substrate, image receiving element, light impervious layer and light-sensitive element is then laminated to the permanent, preferably light impervious, substrate before it is expelled from the camera. If the spreading element is to be used only once, the surface contact may be permanent, and the spreading sheet may then function as the permanent substrate or it may be left between the permanent substrate and the original light-sensitive element. In either case, the colored transfer image produced is then seen the right way round (non side-reversed), through the transparent auxiliary substrate the light-impervious layer serving as image background. Alternatively, according to another embodiment of the dye diffusion transfer process, the image receiving element which carries the final image after transfer of dye may be separated from the original light-sensitive element, for example, by means of a stripping layer placed between the two elements. Information on such an embodiment may be found, for example, in German Offenlegungsschrift No. 2,049,688.

The color-providing compounds used may, in principle, be any compounds which produce diffusible dyes on development of the light-sensitive element. They may be colored compounds which are capable of diffusion and begin to diffuse when the layers are treated with an alkaline processing liquid but are fixed by development in those areas which were exposed to light. On the other hand, the color providing compounds may be resistant to diffusion and release a diffusible dye during development. Color-providing compounds which are a priori capable of diffusion have been disclosed, for example, in German Pat. Nos. 1,036,640; 1,111,936 and 1,196,075. The so-called "dye developers" described in the said Patents contain, in one and the same molecule, both a dye residue and a group which is capable of developing exposed silver halide.

Among the various known processes for the production of colored photographic images by the dye diffusion transfer process, those based on the use of colour-providing compounds which are incorporated in the photographic material in a diffusion resistant form and from which diffusible dyes or dye precursor products are released imagewise by development and transferred to an image receiving layer have recently become increasingly important.

Among the color-providing compounds suitable for this purpose may be included, for example, the non-diffusible color couplers described in German Pat. No. 1,095,115 which, in the development process react with the oxidation product of a color developer compound consisting of a primary aromatic amine, as a result of which they release a diffusible dye which is either preformed or produced by color coupling. The choice of developer compounds is, of course, in this case restricted to color developers.

Also to be mentioned are the non-diffusible color-providing compounds described in German-Offenlegungsschrift No. 1,930,215, in which a preformed, latently diffusible dye residue is attached by way of a decomposable hydrazone group of a residue which confers diffusion resistance. These compounds should not be regarded as color couplers and it has been found that the choice of developer compounds required for releasing the diffusible dye residue is by no means restricted to the usual color developers but may well include black-and-white developers, e.g. pyrocatechols.

Non-diffusible colored compounds which carry a special group and undergo an oxidative ring closure reaction on development to release a preformed dye residue in a diffusible form have been described in German Offenlegungsschrift No. 1,772,929. The compounds disclosed in the said document may be divided into two groups. The compounds of one group require a conventional color developer compound for development. They undergo a coupling reaction with the oxidation product of this developer compound and, in a subsequent ring closure reaction, they release the preformed dye residue in diffusible form. The compounds belonging to the other group are themselves silver halide developers and, in their oxidized form, they are capable of entering into the above mentioned ring closure reaction to release the diffusible dyes even without the presence of any other developer compounds.

Lastly, there should also be mentioned the non-diffusible color-providing compounds according to German Offenlegungsschrift No. 2,242,762. These compounds are sulfonamidophenols and sulfonamidoanilines. After the oxidation reaction of development, they split under the influence of the developer alkali to release diffusible dyes which have a free sulfamoyl group. The color-providing compounds according to German Offenlegungsschrift No. 2,505,248 and according to German Offenlegungsschrift No. 2,645,656 should also be mentioned at this point.

The non-diffusible color-providing compounds mentioned above are without exception negative in their function, i.e. when the usual negatively functioning silver halide emulsions are used, the imagewise distribution of the diffusible dye released corresponds with the negative silver image produced on development. The production of positive dye images therefore requires the use of direct positive silver halide emulsions or a suitable reversal process. Particularly suitable direct positive silver halide emulsions are found to be those in which the sensitivity to light is located predominantly in the interior of the silver halide grains and which are unfogged and are treated with a suitable fogging agent before or during development.

Non-diffusible color-providing compounds which are capable of splitting under alkaline development conditions to release a diffusible dye but in which this splitting reaction is difficult or impossible when they are in their oxidized form have been mentioned in German Offenlegungsschrift Nos. 2,402,900 and 2,543,902. Compounds of this type are suitable for use in combination with conventional negative emulsions for the production of positive transfer images.

EXAMPLE 1

0.5 ml of developer was applied at discrete points to a cambric sheet weighing 100 g/m$^2$.

The developer had the following composition:

1.5 g of Metol
6 g of hydroquinone
25 g of sodium sulphite
40 g of sodium carbonate
1 g of potassium bromide made up with water to 1000 ml.

This quantity of 0.5 ml spread over an area of 175 cm$^2$ within 20 seconds. An imagewise exposed photographic material containing a silver bromide emulsion layer was pressed with its sensitive side against the moistened part of the fabric and kept in contact with it for one minute. The photographic material was then fixed and washed in the usual manner. The image developed using the spreading sheet was of good quality.

EXAMPLE 2

0.5 cc of developer was applied at discrete points to a filter paper weighing 122 g/m$^2$, in the same way as in Example 1. This quantity of developer spread over an area of 105 cm$^2$ within 10 seconds. The image produced with the aid of this spreading sheet, as in Example 1, was of good quality.

EXAMPLE 3

0.5 cc of developer was applied at discrete points to blotting paper weighing 34 g/m$^2$. The developer spread over an area of 143 cm$^2$ within 10 seconds. The image produced with the aid of this spreading sheet, as in Example 1, was of good quality.

EXAMPLE 4

A porous plate of sintered bronze (Sika B 8), 5 mm in thickness, having pores of 8 $\mu$, was bathed for one minute in dilute nitric acid solution and then rinsed with water. The sintered plate was thereby rendered completely hydrophilic and could be impregnated with aqueous developer solution.

5 cc of developer solution were absorbed into the plate within 2 seconds and spread over an area of 22 $cm^2$.

Images of good quality were obtained when a flexible photographic layer was pressed firmly against the plate.

The composition of the developers used in the above examples may vary very widely. The invention is equally suitable for black-and-white developers and color developers and the spreading of developer is, to a large extent, independent of its composition and dependent mainly on its viscosity. Other photographic processing baths may be similarly used.

EXAMPLE 5

A porous plate of high molecular low pressure polyethylene (Supralen RCH 1000), having an average pore width of 40 $\mu$, was impregnated with a developer in which the solvent consisted of 50–75% of water-miscible organic solvents, e.g. acetone or ethyl alcohol, and 50–25% of water. The other constituents of the developer, based on the quantity of water, were unchanged.

5 ml of a developer containing 75% of acetone as solvent spread evenly over an area of 24 $cm^2$ within 3.5 seconds.

When an exposed photographic layer was pressed against the impregnated plate, an image of satisfactory quality was developed in the layer. This process could be repeated at least twice without fresh developer.

I claim:

1. A process for processing a photographic material of a single-layered or multi-layered photosensitive material with a low viscosity processing liquid comprising the steps of contacting a surface of the uppermost layer of the photographic material with a spreading element consisting essentially of a material having the characteristics of providing distribution of liquid by capillary forces in a very thin flat porous spreading means, transferring a processing liquid from a reservoir of said liquid into the flat porous spreading means, circulating additional processing liquid from said reservoir of said liquids to said contact with the photographic material by rapid distribution of the liquid through the flat porous spreading means and over the surface of the photographic material, while the spreading means is in contact with said processed photographic material distributing the processing liquid in the flat porous spreading means, including additional liquid over the surface of the photographic material by capillary force, and processing the photographic material with the processing liquid contacting the photographic material only upon the surface contact of the element with the photographic material surface, while the spreading means is in contact with the photographic material.

2. The process of claim 1 in which the the spreading means are comprised of fibers.

3. The process of claim 1 in which the capillaries of the spreading means are comprised of cambric.

4. The process of claim 1 in which the the spreading means are comprised of a sintered metal plate.

5. The process of claim 1 in which the spreading element is formed integrally with walls containing said liquid reservoir.

6. Process according to claim 1 in which the low viscosity processing liquid has a viscosity $\eta$ of from 1 to 20 mPa.s at room temperature.

* * * * *